US007341047B2

(12) United States Patent
Sone et al.

(10) Patent No.: US 7,341,047 B2
(45) Date of Patent: Mar. 11, 2008

(54) VEHICLE FUEL TANK ASSEMBLY

(75) Inventors: Kitaru Sone, West Bloomfield, MI (US); Todd Marentette, Windsor (CA)

(73) Assignee: Nissan Technical Center North America, Inc.MI (US)

( * ) Notice: Subject to any disclaimer, the term of this patent is extended or adjusted under 35 U.S.C. 154(b) by 0 days.

(21) Appl. No.: 11/501,907

(22) Filed: Aug. 10, 2006

(65) Prior Publication Data

US 2008/0035120 A1 Feb. 14, 2008

(51) Int. Cl.
*F02M 37/04* (2006.01)

(52) U.S. Cl. ..... 123/509; 123/495; 248/540; 248/658; 248/674

(58) Field of Classification Search ..... 123/509, 123/495; 248/540, 658, 674
See application file for complete search history.

(56) References Cited

U.S. PATENT DOCUMENTS 3,485,133 A * 12/1969 Rapata ..... 411/508
5,271,518 A * 12/1993 Webb ..... 220/320
5,463,974 A * 11/1995 Seeder ..... 116/173
5,819,476 A * 10/1998 Annestedt, Sr. ..... 52/11
5,860,796 A * 1/1999 Clausen ..... 417/423.9
6,182,693 B1 2/2001 Stack et al.
6,192,918 B1 * 2/2001 Jaasma et al. ..... 137/382
6,206,037 B1 * 3/2001 Murakoshi et al. .... 137/565.34
6,435,365 B2 8/2002 Pachciarz et al.
6,533,288 B1 * 3/2003 Brandner et al. ..... 277/630
6,543,426 B1 4/2003 Schwochert
7,025,385 B2 * 4/2006 Drescher ..... 285/91
7,083,065 B2 * 8/2006 Zdroik ..... 220/562
7,086,493 B2 * 8/2006 Knight ..... 180/274
2005/0034760 A1 2/2005 Burke et al.
2006/0042378 A1 3/2006 Tanaka et al.
2006/0081395 A1 4/2006 Motoda

* cited by examiner

*Primary Examiner*—Stephen K. Cronin
*Assistant Examiner*—J. Page Hufty
(74) *Attorney, Agent, or Firm*—Global IP Counselors

(57) ABSTRACT

A vehicle fuel tank assembly includes a fuel tank having a fuel pump receiving opening, a fuel pump, a mounting ring, at least one attachment member (a clip) and a fuel pump cover. The fuel pump is disposed in the fuel pump receiving opening such that a portion of the fuel pump is exposed. The mounting ring secures the fuel pump to the fuel tank. The at least one attachment member has a ring attachment portion connected to the mounting ring and a cover attachment portion. The fuel pump cover is connected to the cover attachment portion of the attachment member to substantially cover at least the exposed portion of the fuel pump.

37 Claims, 17 Drawing Sheets

VEHICLE FUEL TANK ASSEMBLY

BACKGROUND OF THE INVENTION

1. Field of the Invention

The present invention generally relates to a vehicle fuel tank assembly. More specifically, the present invention relates to a vehicle fuel tank assembly that includes a fuel pump cover.

2. Background Information

For many years now pickup trucks have been used for both personal and commercial uses. The cargo beds of pickup trucks typically have to withstand the ravages of sustained cargo hauling. Whether the cargo is commercial or household related, there can be spills of solvents and mildly caustic materials within the cargo bed. Since the fuel tank of a pickup truck is typically located at least partially or completely under the cargo bed, it is desirable to also protect portions of the fuel tank against such spills, such as the fuel delivery lines and fuel pump power supply lines.

In view of the above, it will be apparent to those skilled in the art from this disclosure that there exists a need for an improved fuel tank assembly. This invention addresses this need in the art as well as other needs, which will become apparent to those skilled in the art from this disclosure.

SUMMARY OF THE INVENTION

In accordance with one aspect of the present invention, a vehicle fuel tank assembly includes a fuel tank, a fuel pump, a mounting ring, at least one attachment member (a clip) and a fuel pump cover. The fuel tank includes a fuel pump receiving opening with the fuel pump disposed in the fuel pump receiving opening such that a portion of the fuel pump is exposed. The mounting ring secures the fuel pump to the fuel tank. The attachment member has a ring attachment portion connected to the mounting ring and a cover attachment portion. The fuel pump cover is connected to the cover attachment portion of the attachment member to substantially cover at least the exposed portion of the fuel pump.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 18 is a cross-sectional view similar to FIG. 9 showing the mounting ring, the cover and a clip in accordance with the second embodiment of the present invention.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
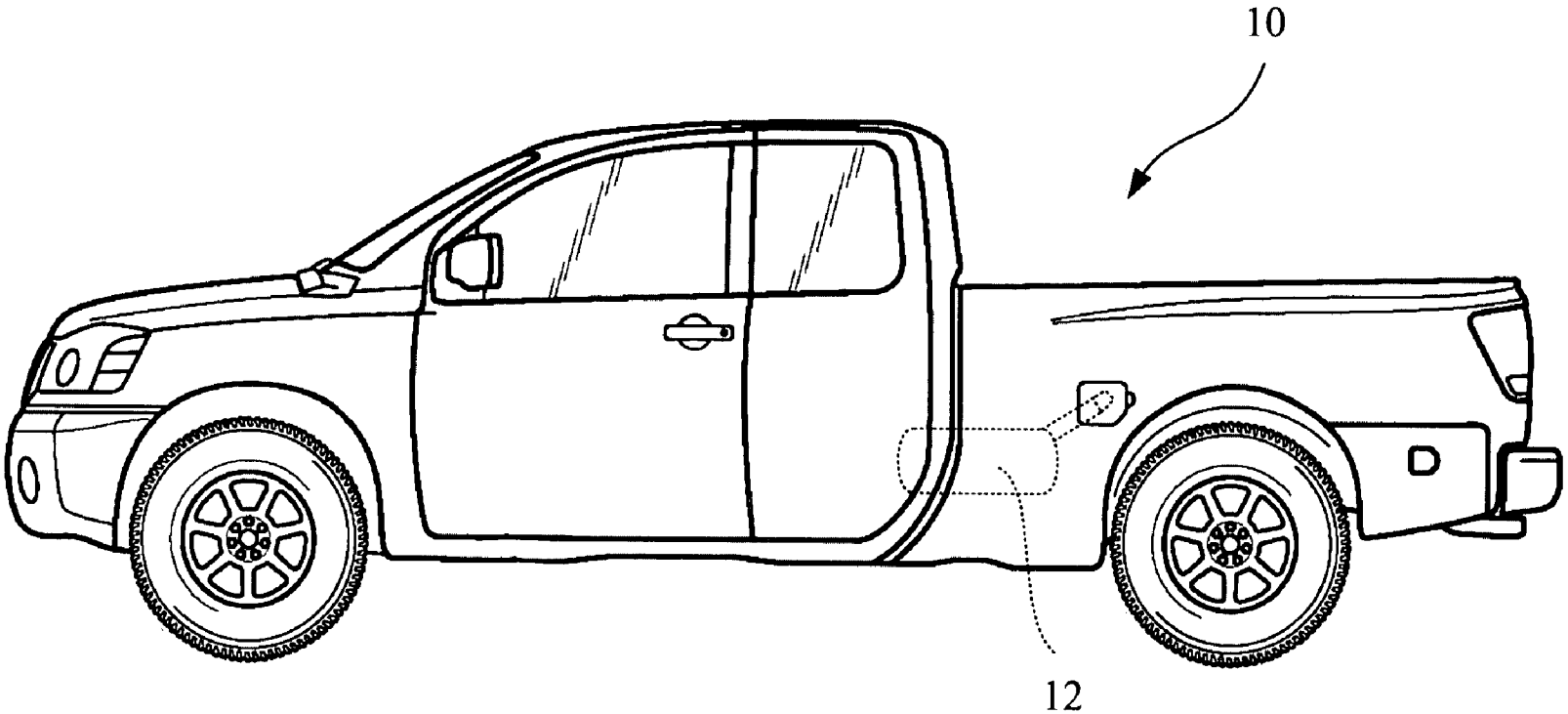
FIG. 1 is a side elevational view of a vehicle showing a fuel tank assembly in phantom that is at least partially disposed under a cargo bed of the vehicle in accordance with the present invention.
Figure 2:
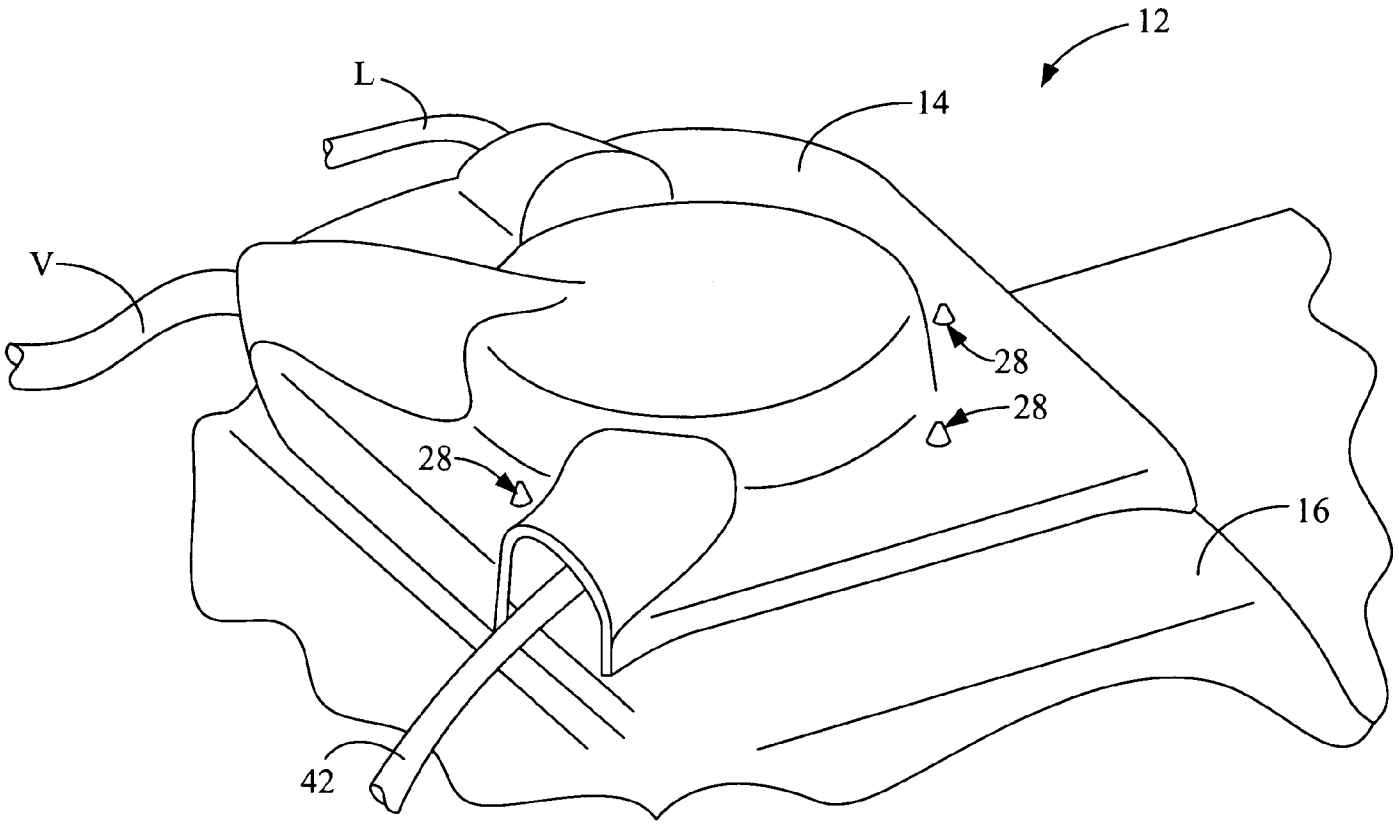
FIG. 2 is a perspective view of a portion of the fuel tank assembly showing a cover that covers an exposed portion of a fuel pump of the fuel tank assembly in accordance with a first embodiment of the present invention.

Referring initially to FIG. 1, a vehicle 10 that includes a fuel tank 12 (a fuel tank assembly) is illustrated in accordance with a first embodiment of the present invention. As shown in FIG. 2, the fuel tank 12 includes a cover 14 described in greater detail below.

Figure 3:
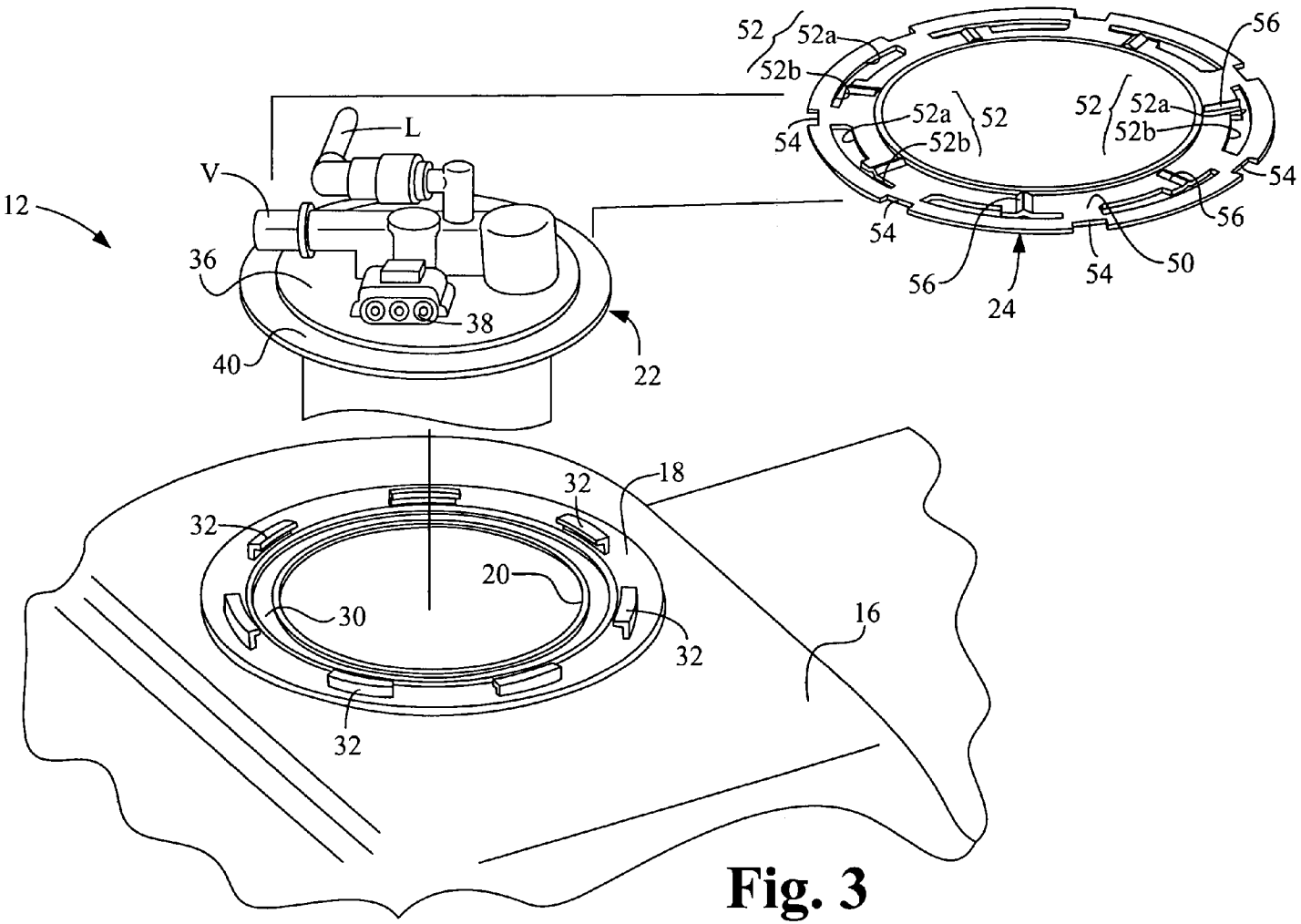
FIG. 3 is an exploded perspective view of the portion of the fuel tank assembly depicted in FIG. 2, showing features of the fuel pump, a mounting ring and a flange of the fuel tank assembly with the cover removed to provide greater clarity in accordance with the first embodiment of the present invention.
Figure 4:
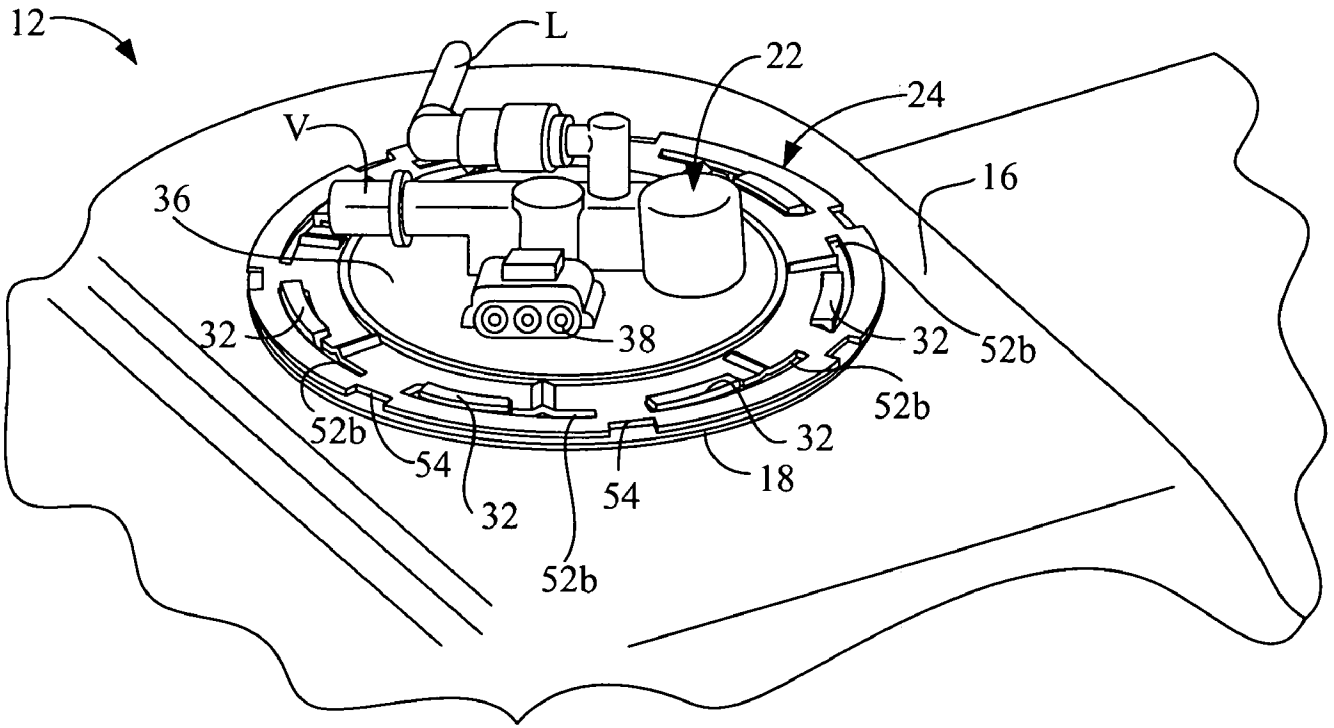
FIG. 4 is a perspective view of the portion of the fuel tank assembly depicted in FIGS. 2 and 3 showing the fuel pump positioned on the flange of the fuel tank assembly with the mounting ring loosely positioned on the flange in an unsecured orientation and the fuel pump in accordance with the first embodiment of the present invention.

With reference now to FIGS. 3 and 4, a description of the fuel tank 12 is now provided. FIGS. 3 and 4 show features of the fuel tank 12 with the cover 14 removed.

As shown in FIG. 3, the fuel tank 12 includes an upper surface 16, a flange 18, a fuel pump receiving opening 20, a fuel pump 22 and a mounting ring 24. As shown in FIG. 2, the cover 14 is retained on the fuel tank 12 by a plurality of clips 28 in a manner described in greater detail below.

Figure 7:
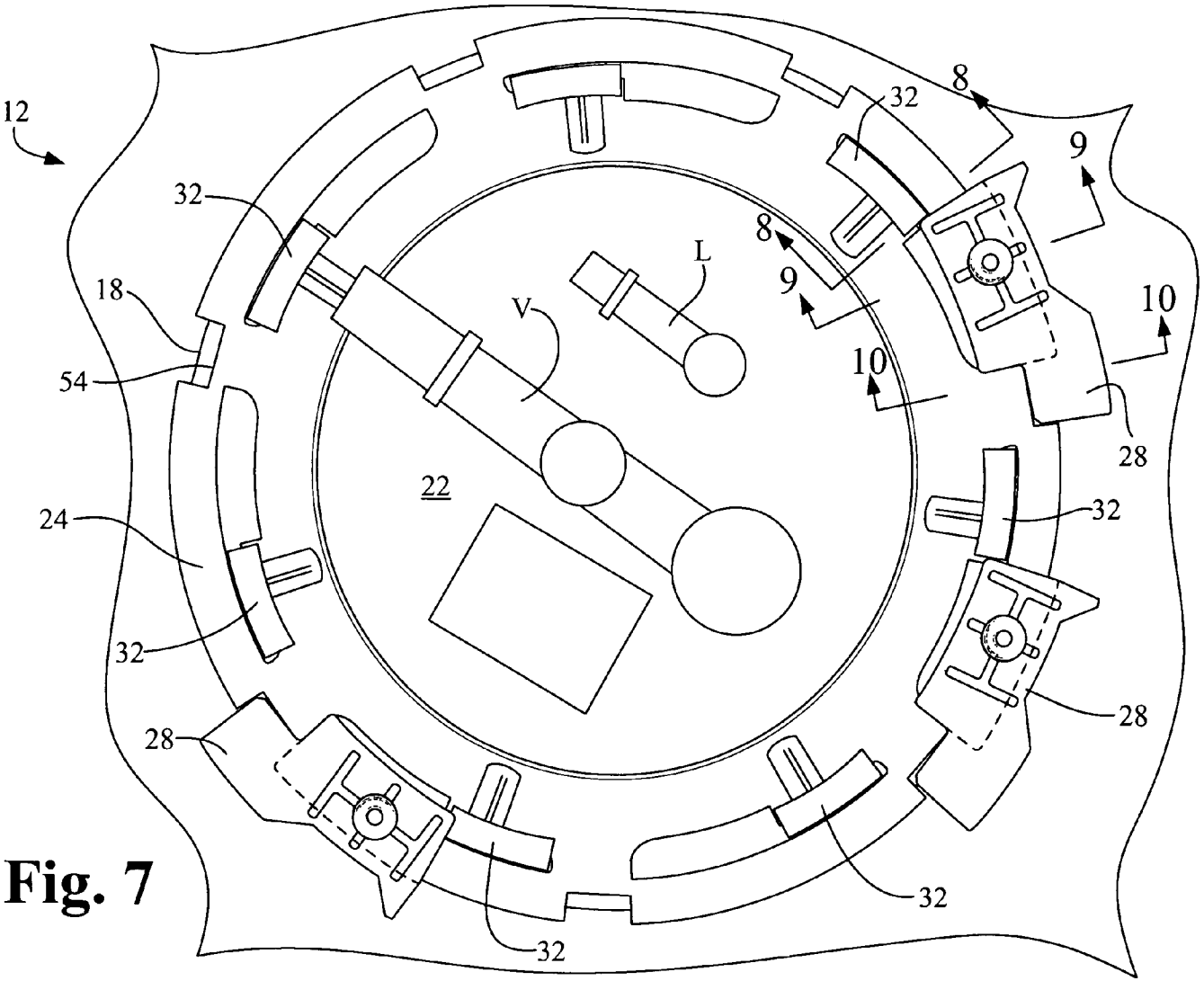
FIG. 7 is a top plan view of the portion of the fuel tank assembly depicted in FIGS. 2-6 with the cover removed to provide greater clarity showing the clips on the mounting ring in accordance with the first embodiment of the present invention.
Figure 8:
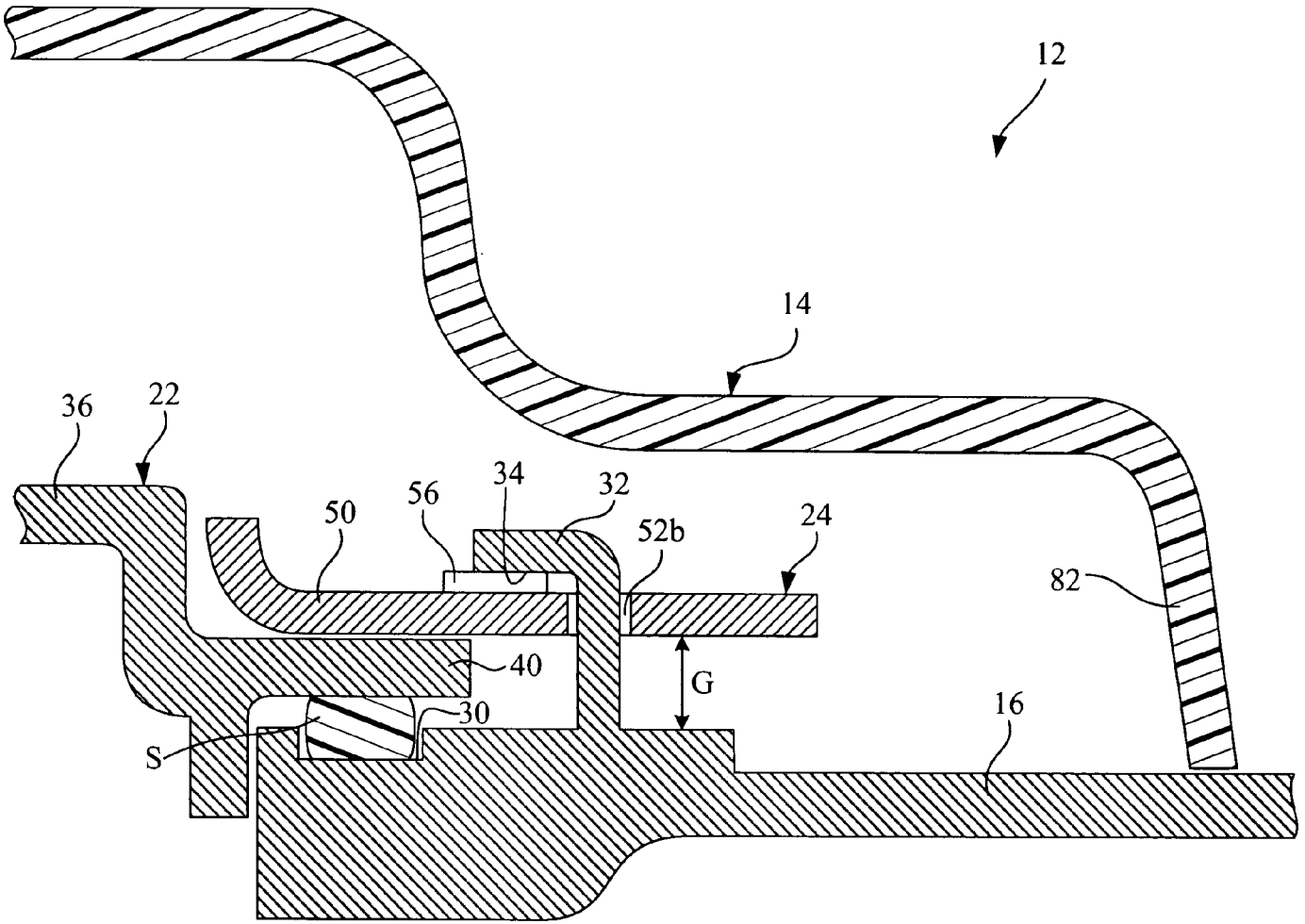
FIG. 8 is a cross-sectional view of the portion of the fuel tank assembly taken along the line 8-8 in FIG. 7 showing the flange, the fuel pump, the mounting ring and the cover in accordance with the first embodiment of the present invention.

With reference again to FIGS. 3 and 4, the flange 18 is fixed to the upper surface 16 in a conventional manner and encircles the fuel pump receiving opening 20. Specifically, the flange 18 can be welded to the fuel tank 12, formed integrally with the fuel tank 12, fixed with adhesives or other mechanical connections depending upon manufacturing and design considerations. As shown in FIG. 3, the flange 18 is a fuel pump support portion that includes an annular recess 30 and a plurality of retaining protrusions 32. Each of the retaining protrusions 32 has an arcuate shape when viewed from above (FIG. 7) and a hook-shape when viewed in cross-section as shown in FIG. 8. Each of the retaining protrusions 32 further includes a surface 34 (FIG. 8) configured to retain the mounting ring 24 on the flange 18 in a conventional manner, as described further below. Hence, the retaining protrusions 32 are securing members that retain the mounting ring 24 and the fuel pump 22 to the fuel tank 12.

The fuel pump 22 includes a pump motor (not shown) and a support plate 36 having a fuel line L, a vapor line V (or return line) and a connector 38. The support plate 36 at least partially defines a fuel tank housing that includes an annular outer flange 40. The connector 38 is configured to connect with a wiring harness 42 (FIG. 2) in a conventional manner for supplying power to the fuel pump 22 and transmit signals from a fuel tank level measuring device (not shown). With the fuel pump 22 disposed in the fuel pump receiving opening 20, the support plate 36 is exposed and the remainder of the fuel pump 22 is concealed within the fuel tank 12. Hence, the support plate 36 is an exposed portion of the fuel pump 22.

The mounting ring 24 secures the fuel pump 22 to the fuel tank 12. As shown in FIG. 3, the mounting ring 24 includes an outer annular surface 50 having a plurality of arcuate shaped slots 52, a plurality of recesses 54 and a plurality of ribs 56. The slots 52 extend from the outer annular surface 50 to an inner annular surface (an underside of the mounting ring 24). The slots 52 have a wide portion 52*a* and a narrowed portion 52*b*. The recesses 54 are located along a radially outer edge of the outer annular surface 50. The number of slots 52 corresponds with the number of retaining protrusions 32. Further, the retaining protrusions 32 and the slots 52 are dimensioned to align with one another in a conventional manner.

Figure 5:
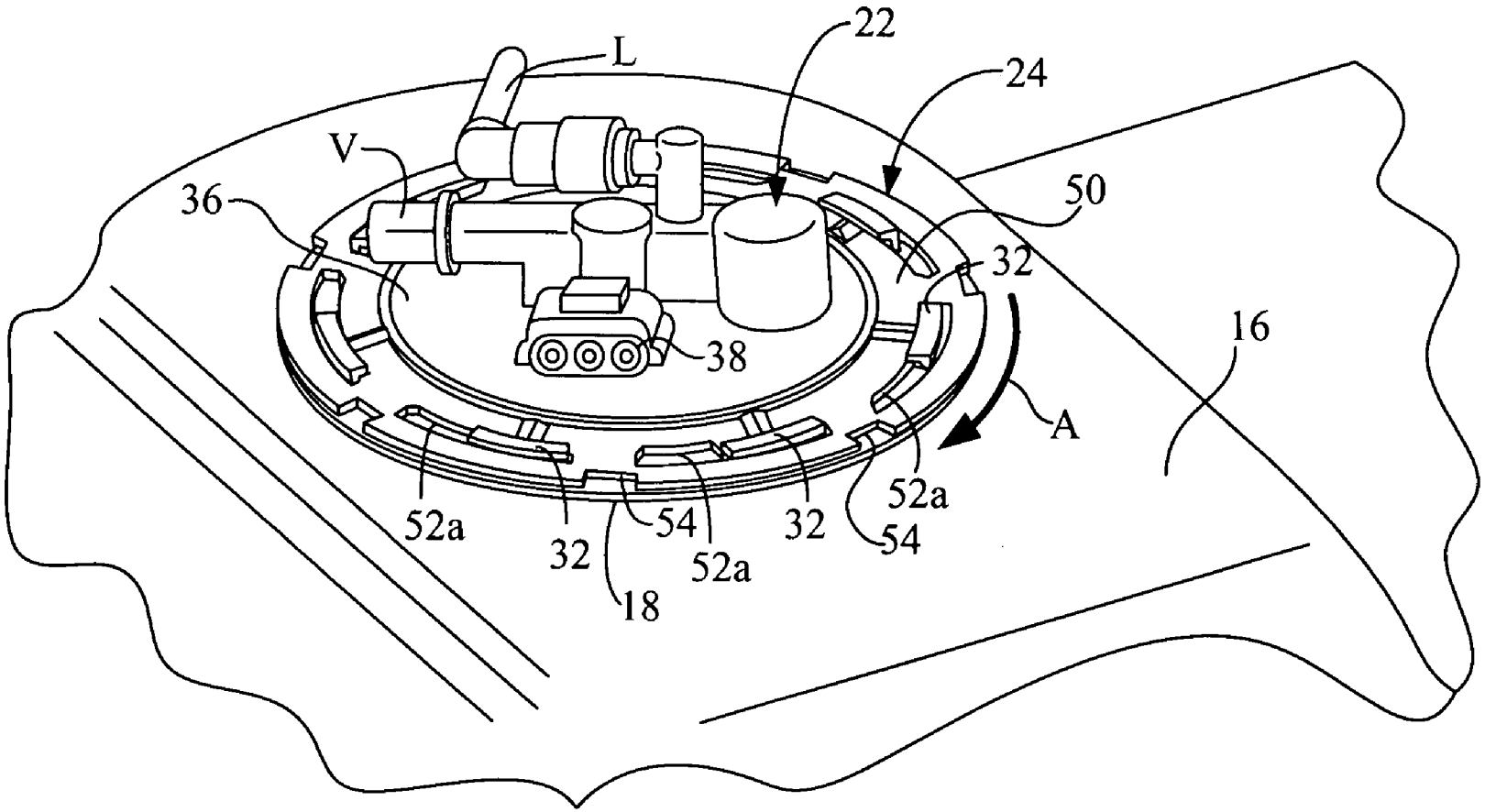
FIG. 5 is a perspective view of the portion of the fuel tank assembly depicted in FIGS. 2, 3 and 4 showing the mounting ring rotated into a securing orientation with respect to the flange and the fuel pump in accordance with the first embodiment of the present invention.
Figure 6:
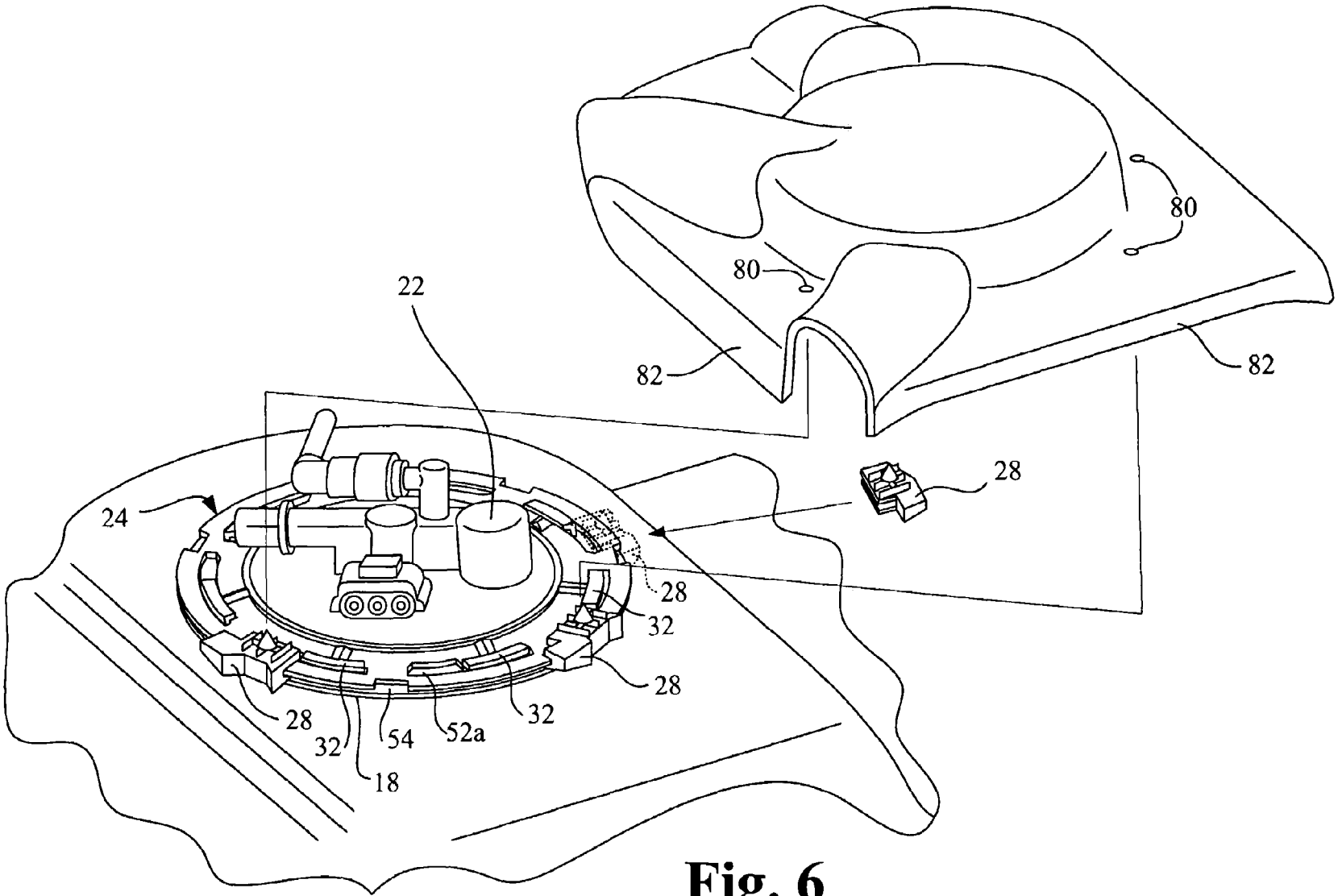
FIG. 6 is an exploded perspective view of the portion of the fuel tank assembly depicted in FIGS. 2-5 showing a plurality of clips, with the clips installed on portions of the mounting ring and the cover ready to be installed on the clips in accordance with the first embodiment of the present invention.
Figure 9:
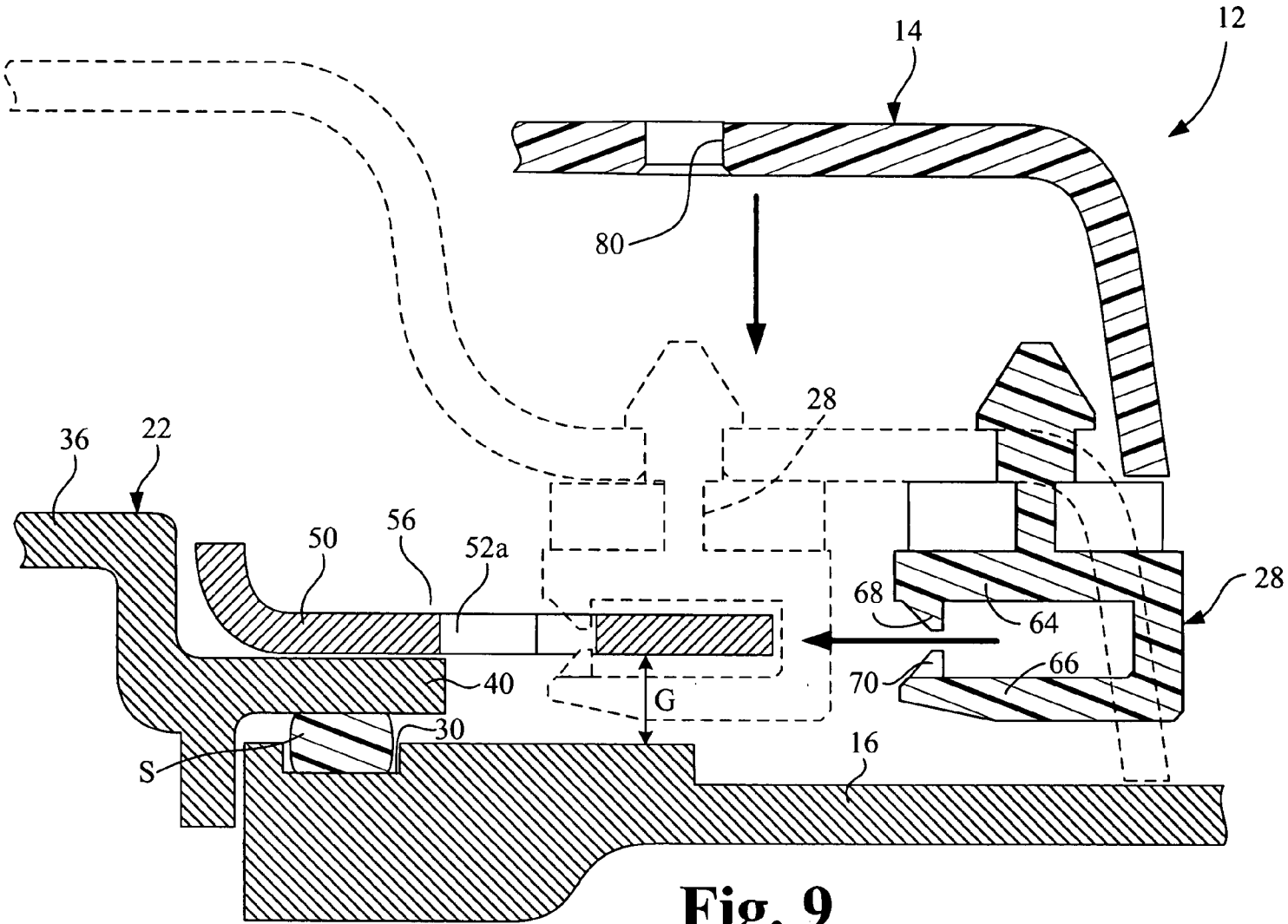
FIG. 9 is a cross-sectional view of the portion of the fuel tank assembly taken along the line 9-9 in FIG. 7 showing the flange, the fuel pump, the mounting ring, one of the clips and the cover in accordance with the first embodiment of the present invention.
Figure 10:
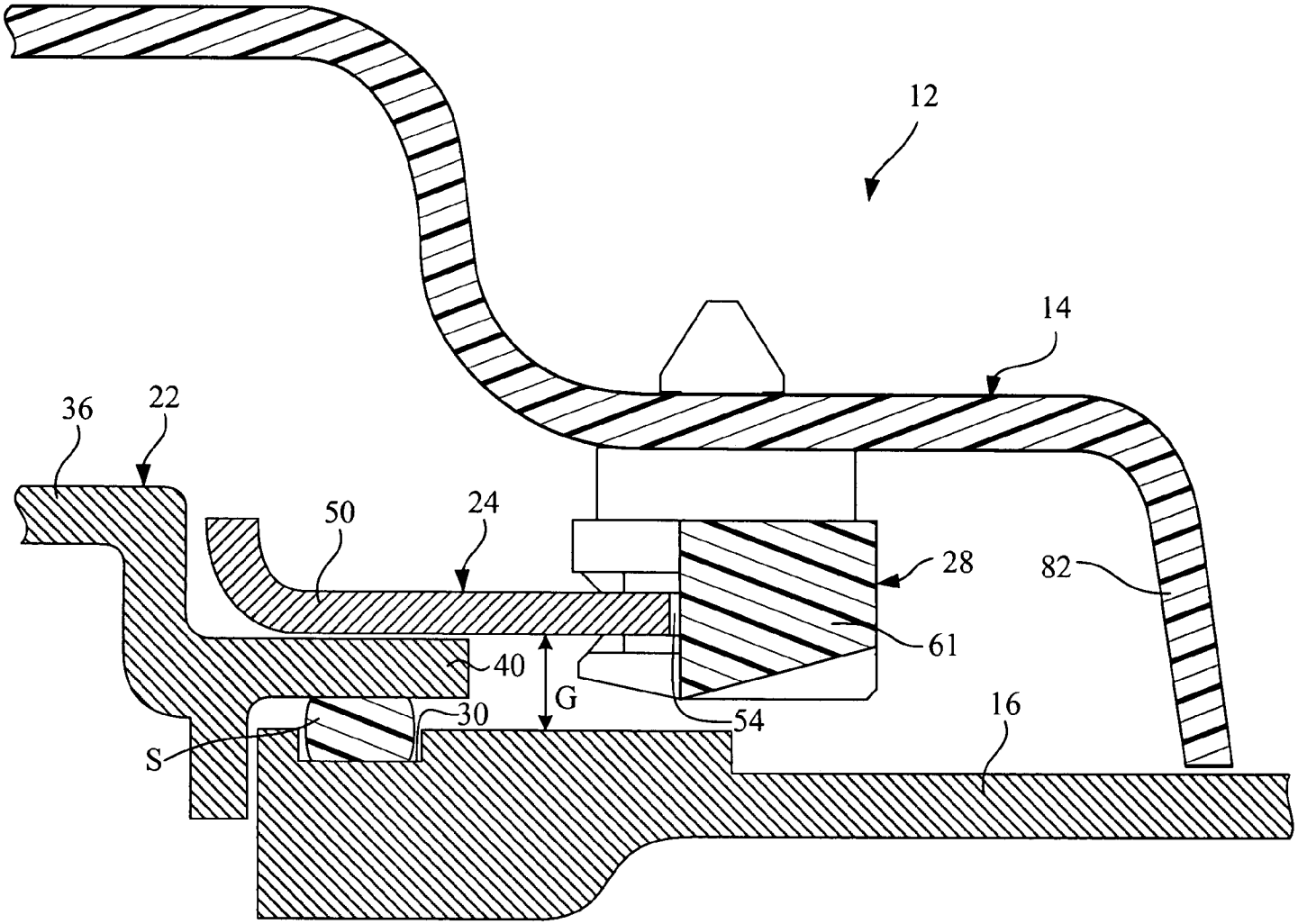
FIG. 10 is another cross-sectional view of the portion of the fuel tank assembly taken along the line 10-10 in FIG. 7 showing the flange, the fuel pump, the mounting ring, a recess in the mounting ring that receives an anti-rotation portion of the clip and the cover in accordance with the first embodiment of the present invention.

As indicated in FIGS. 3, 4 and 5, the fuel pump 22 installs in the fuel tank 12 such that the support plate 36 is disposed on the annular recess 30 of the flange 18. Thereafter, the mounting ring 24 can be installed in a conventional manner. To install the mounting ring 24, the wide portions 52*a* of the slots 52 of the mounting ring 24 are positioned above the retaining protrusions 32 of the flange 18. The mounting ring 24 is lowered such that the retaining protrusions 32 extend through the wide portions 52*a* of the slots 52, as shown in FIG. 4. FIG. 4 shows the mounting ring 24 in an unsecured orientation on the flange 18 of the fuel tank 12. The mounting ring 24 is then rotated (using some force) in the direction the arrow A in FIG. 5, such that narrowed portions 52*b* of the slots 52 move adjacent to respective ones of the retaining protrusions 32. This forced rotation of the mounting ring 24 causes the surface 34 of the retaining protrusions 32 to engage the outer annular surface 50 adjacent to the narrowed portions 52*b* of the mounting ring 24. Hence, FIGS. 5 and 6 show the mounting ring 24 in a secured orientation on the flange 18. Specifically, contact between the ribs 56 on the outer annular surface 50 and the surface 34 of the retaining protrusions 32 retains the mounting ring 24 and the fuel pump 22 securely on the fuel tank 12. An annular seal S is typically positioned within the recess 30 between the flange 18 and the support plate 36 to seal the fuel tank 12, as shown in FIGS. 8, 9 and 10.

Once the mounting ring 24 is installed on the fuel tank 12, the wide portions 52*a* of the slots 50 of the mounting ring 24 are exposed (as shown in 6) since the retaining protrusions 32 now extend through the narrowed portions 52*b* of the slots 52, as shown in FIG. 8. Further, due to the relative thicknesses of the flange 18, the support plate 36 of the fuel pump 22 and the mounting ring 24, an outer periphery of the mounting ring 24 is spaced apart from the flange 18 forming a gap G, as shown in FIGS. 8, 9 and 10.

With reference to FIGS. 11-16, a description of the plurality of clips 28 is now provided. Each clip 28 is an attachment member that attaches to the mounting ring 24 and further provides for attachment of the cover 14, as described below. Since the clips 28 are all the same, description of one clip 28 applies to all of the clips 28.

The clip 28 is a one-piece, unitary member that is preferably made from nylon, acetal, polypropylene or any of a variety of plastic materials or polymer materials with appropriate levels of rigidity such that the clip 28 connects to the mounting ring 24 with a snap-fit, as described below. The clip 28 basically includes a ring attachment portion 60, an anti-rotation portion 61 and a cover attachment portion 62. The ring attachment portion 60 includes an upper section 64 and a lower section 66 (a pair of generally parallel engagement elements). The upper and lower sections 64 and 66 are spaced apart from one another by a distance that is only slightly larger than the thickness of the mounting ring 24, as shown in FIG. 9. The upper and lower sections 64 and 66 are generally parallel to one another such that they are easily and simply disposed on opposite sides of the mounting ring 24.

Figure 11:
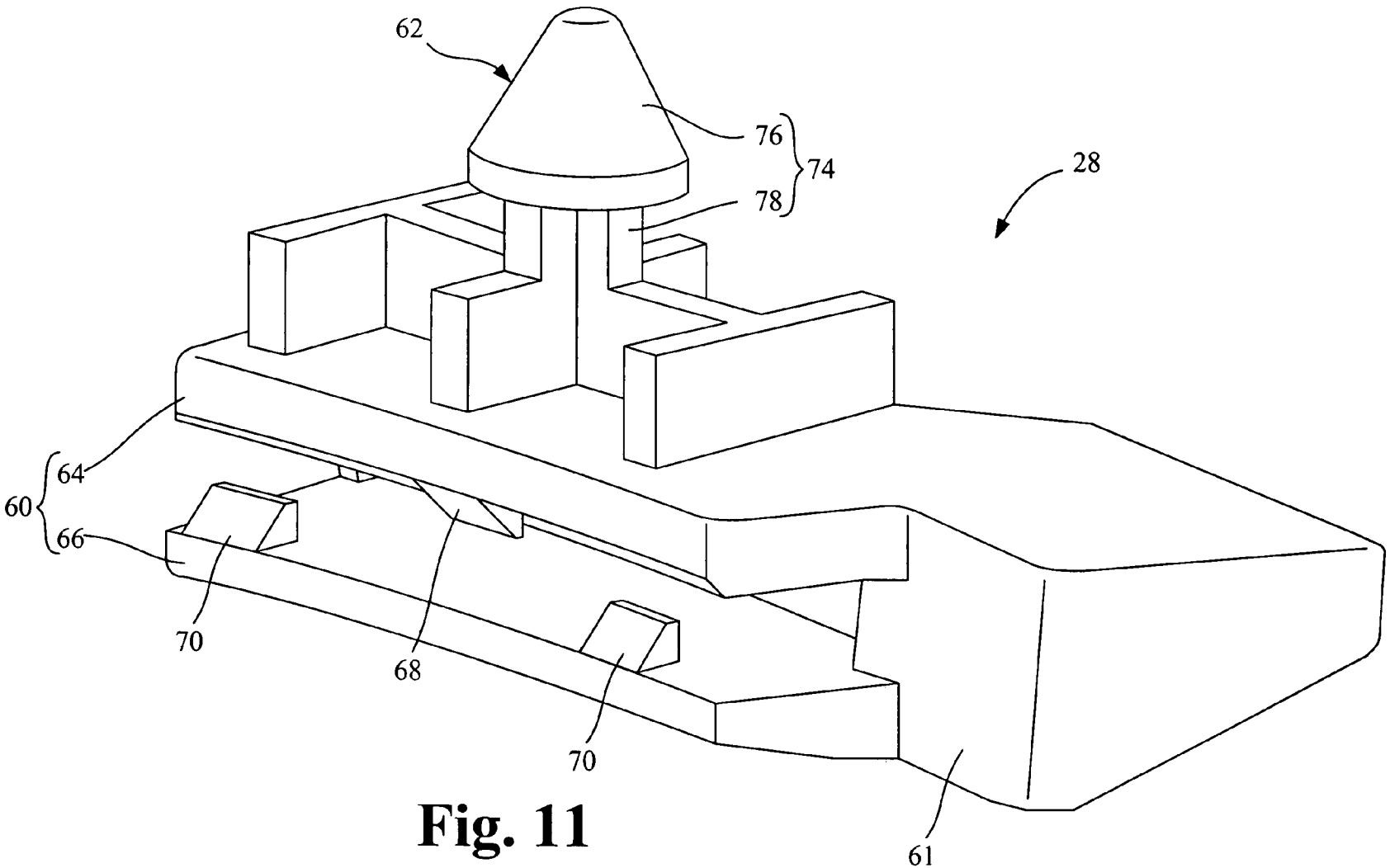
FIG. 11 is an enlarged perspective view of one of the plurality of clips shown removed from the fuel tank assembly in accordance with the first embodiment of the present invention.
Figure 12:
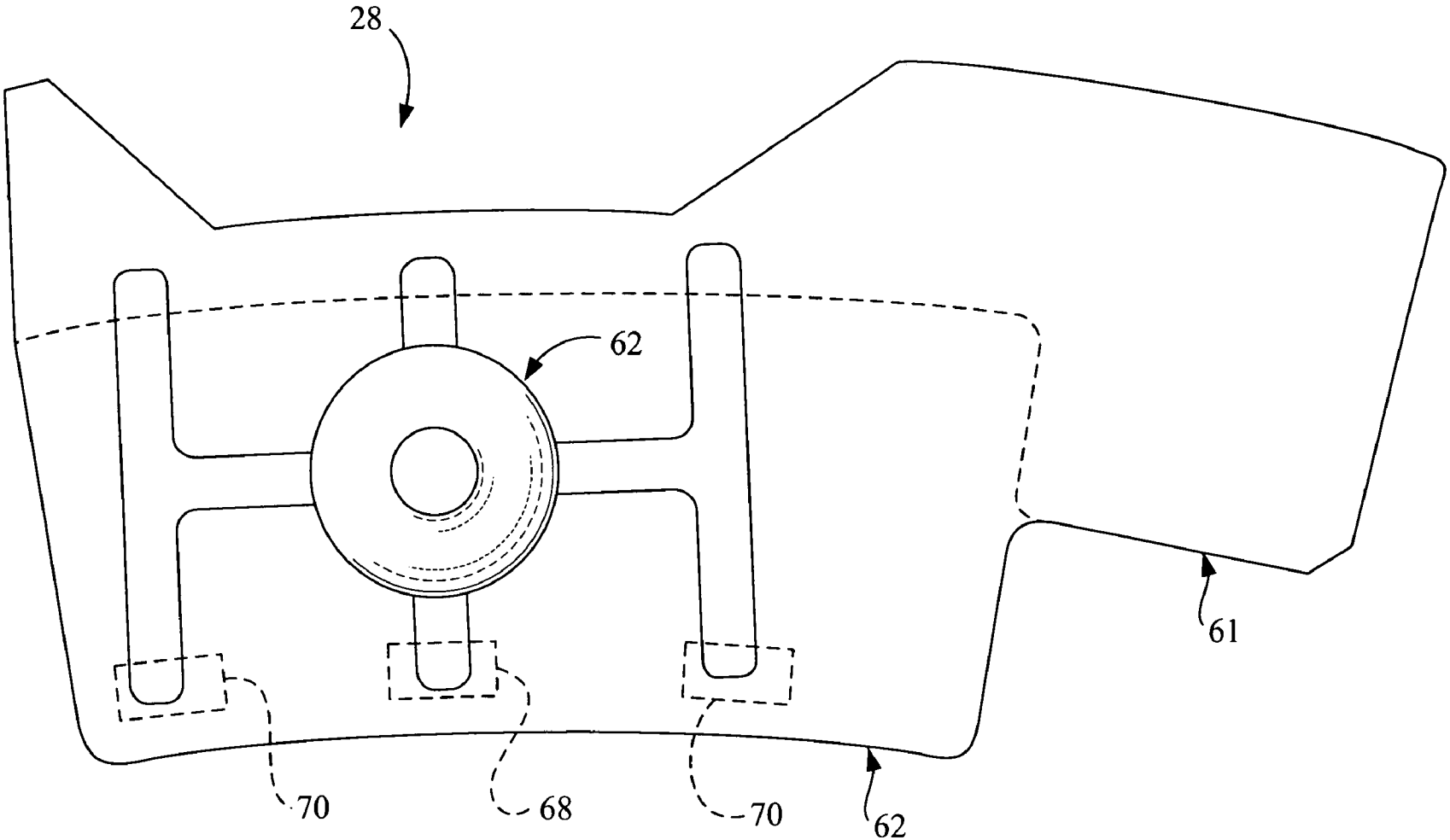
FIG. 12 is an enlarged top plan view of the clip depicted in FIG. 11 shown removed from the fuel tank assembly in accordance with the first embodiment of the present invention.
Figure 14:
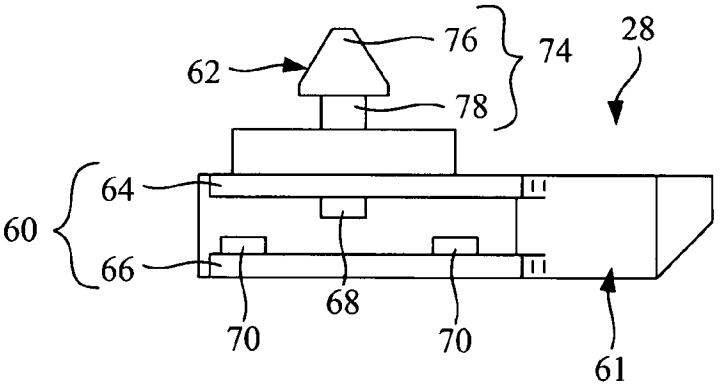
FIG. 14 is a mounting ring side of the clip in accordance with the first embodiment of the present invention.
Figure 16:
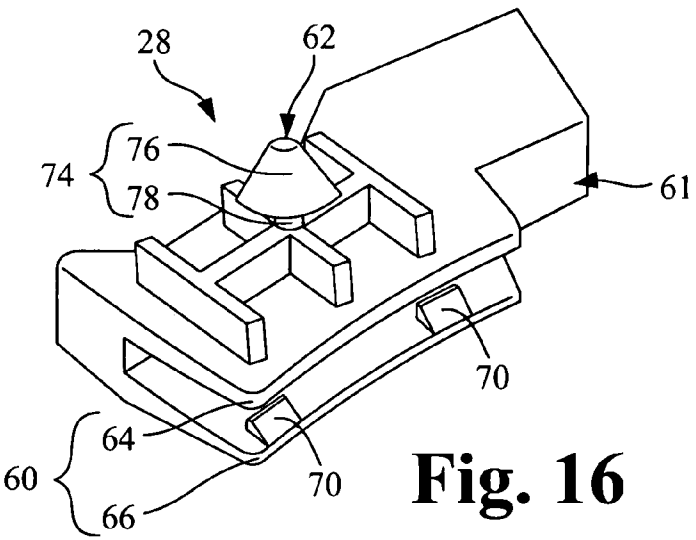
FIG. 16 is another perspective view of the clip in accordance with the first embodiment of the present invention.
Figure 13:
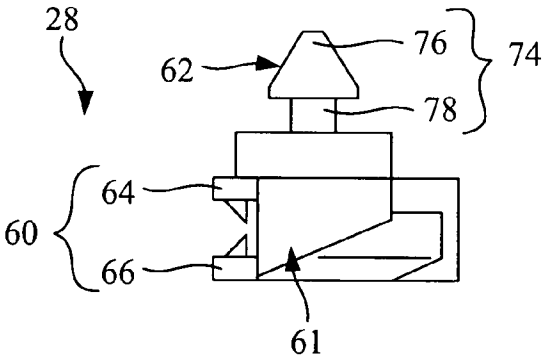
FIG. 13 is an end view of the clip in accordance with the first embodiment of the present invention.
Figure 15:
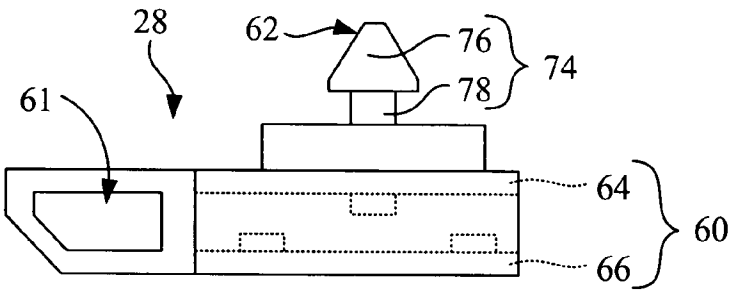
FIG. 15 is an outer side of the clip in accordance with the first embodiment of the present invention.

As shown in FIGS. 9 and 11, the upper section 64 includes at least one protrusion 68 that extends toward the lower section 66. The lower section 66 includes at least one protrusion 70 that extends toward the upper section 64. In the depicted embodiment, there is one protrusion 68 and there are two protrusions 70, however this is for example only. There can be several of each of the protrusions 68 and 70, or alternatively, only one of each, depending upon a variety of factors, such as the size of the cover 14 and/or the size of the fuel tank 12. The protrusions 68 and 70 work together to provide a snap-fit engagement with the mounting ring 24, as described in greater detail below. The protrusions 68 and 70 are provided to prevent movement in a radially outward direction relative to the mounting ring 18, once the clips 28 are installed on the mounting ring 18

The anti-rotation portion 61 is configured and arranged relative to the mounting ring 24 to prevent movement of the clip 28 (the attachment member) in an annular direction along the mounting ring 24. Specifically, the anti-rotation portion 61 has a shape corresponding to the recess 54 in the mounting ring 24. The anti-rotation portion 61 extends into the recess 54 of the mounting ring 24. The engagement between the anti-rotation portion 61 and the protrusions 68 and 70 prevent both radial and annular direction movement of the clip 28 relative to the mounting ring 24. Hence, the ring attachment portion 60 and the anti-rotation portion 61 work together, with the upper and lower sections 64 and 66 (the engagement elements) of the ring attachment portion 60 basically extending from the anti-rotation portion 61. The ring attachment portion 60 at least partially surrounds a portion of the mounting ring 24 and the anti-rotation portion 61 prevents relative annular movement of the clip 28 relative to the mounting ring 24.

The cover attachment portion 62 extends upward from the upper section 64 of the ring attachment portion 60 of the clip 28. The cover attachment portion 62 includes a projection 74 that extends vertically and generally perpendicular to the upper section 64 of the ring attachment portion 60 (one of the engagement elements) to engage the cover 14 via a snap-fit. The projection 74 of the cover attachment portion 62 has a conical shaped free-end 76 and an undercut lower portion that defines a cover receiving recess 78.

In the depicted embodiment, there are three clips 28 (three attachment members). However, it should be understood from the drawings and the description herein that any number of clips 28 can be employed to retain the cover 14 to the fuel tank 12, depending upon the size of the cover 14 and/or the size of the fuel tank 12.

When the clip 28 is installed on the mounting ring 24, the protrusions 68 and 70 engage opposite surfaces of the mounting ring 24 causing the upper section 64 and the lower section 66 to flex or bend slightly allowing the clip 28 to move radially inward on the mounting ring 24. Once the protrusions 68 and 70 reach the wide portion 52*a* of the slot 52, the upper and lower section 64 and 66 un-flex causing the protrusions 68 and 70 to extend into the wide portion 52*a* of the slot 52, as indicated in FIG. 9. Once the protrusions 68 and 70 extend into the wide portion 52*a* of the slot 52, the clip is connected to the mounting in a snap-fit engagement. Further, as shown in FIG. 10, when properly installed, the anti-rotation portion 61 of the clip extends into the recess 54 in the mounting ring 24.

Figure 17:
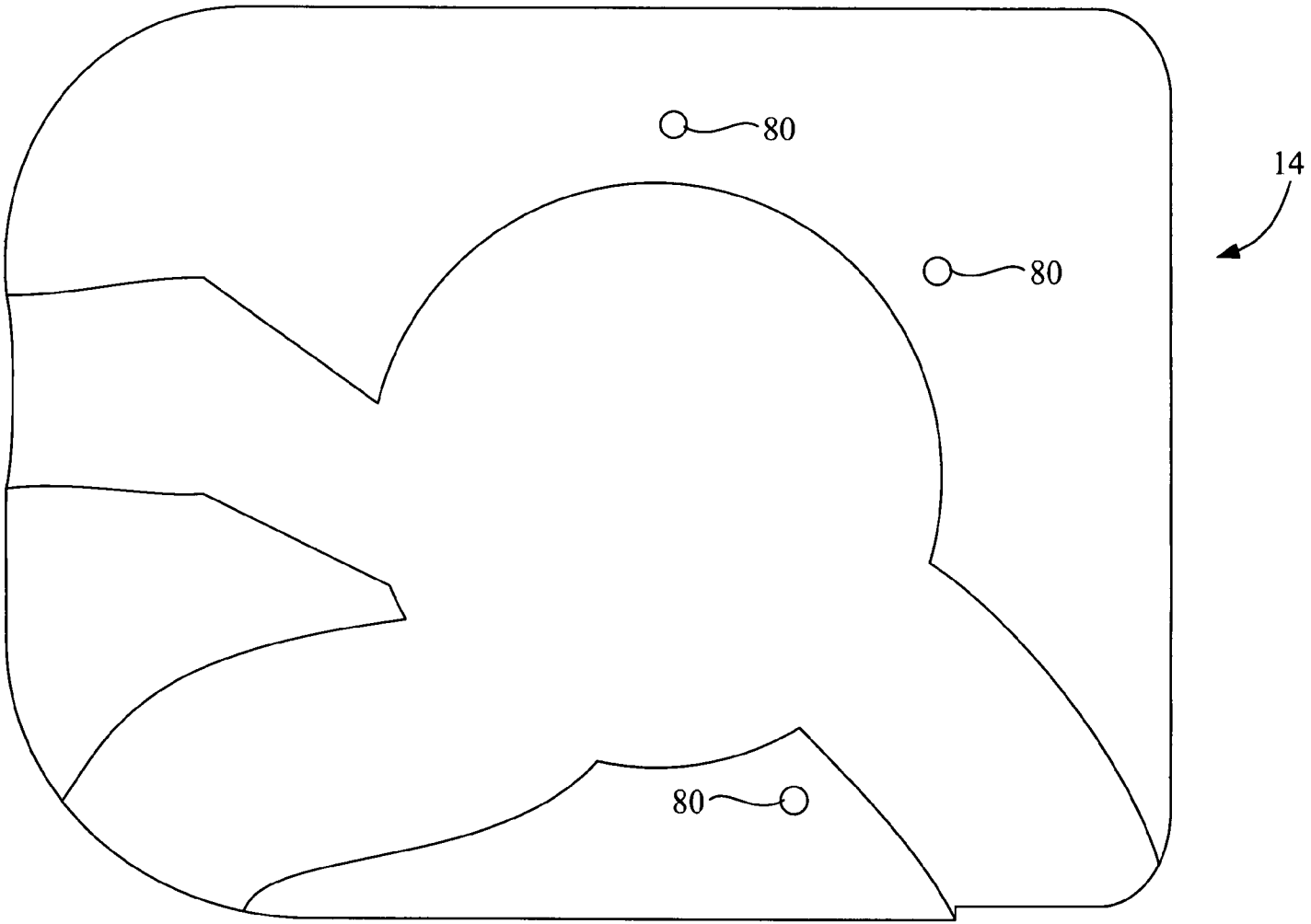
FIG. 17 is a top view of the cover shown removed from the fuel tank assembly in accordance with the first embodiment of the present invention.

With specific reference to FIG. 17, a description of the cover 14 is now provided. The cover 14 is preferably made of any of a variety of materials, such as high density polyethylene (HDPE), polypropylene (PP), nitrile rubber (NBR), thermoplastic olefin (TPO) or other suitable materials that exhibit favorable chemical resistance, such as good acid resistance.

The cover 14 is basically a flat sheet-like member that includes a contoured upper surface that conforms to the generally shape of the fuel line L, the vapor line V, the connector 38 and the wiring harness 42. The cover further includes a plurality of apertures 80 dimensioned to receive the projections 74 of the clips 28. Further, the number of apertures 80 preferably corresponds to the number of clips 28 installed on the mounting ring 24. The cover 14 also includes a skirting perimeter wall 82 that extends downward in order to conceal the support plate 36 of the fuel pump 22 (the exposed portion of the fuel pump.

Although three clips 28 and three apertures 80 are shown in the drawings, any appropriate number of clips 28 and apertures 80 can be employed. The apertures 80 are spaced apart from one another by spacing that corresponds to the spacing between the projections 74 of the clips 28. The cover 14 attaches to the cover attachment portion 62 of the clips 28 to substantially cover the support plate 36 (the exposed portion) of the fuel pump 22. However, the cover 14 also covers the electrical connector 38, the mounting ring 24 and the fuel pump 22. It should be understood from the drawings and the description herein that the cover 14 can be sufficiently large to cover the entire top surface of the fuel tank 22. The size of the cover 14 depends upon the specific uses of the vehicle 10 equipped with the fuel tank 12 and the portions of the fuel tank 12 that require covering.

As is shown in FIGS. 6 and 9, installation of the cover 14 is effected with a few simple steps. First, with fuel pump 22 installed in a fuel tank opening defined by the flange 18 of the fuel tank 12, the mounting ring 24 secures the fuel pump 22 to the fuel tank 12. Next, the clips 28 are installed on the mounting ring 24 as described above. Last, the cover 14 is installed on the projections 74 of the clips 28 thereby covering at least the fuel pump 22 and the mounting ring 24.

As is also shown in FIGS. 6 and 9, the installing procedure of the clips 28 (the attachment members) includes moving the clips 28 along a plane coinciding with an outer radial portion the mounting ring 24. Further, installing the cover 14 includes moving the cover 14 in a direction perpendicular to the plane coinciding with the mounting ring 24. Installing the clip 28 (the attachment members) also includes inserting the anti-rotation portion 61 of the clip 28 into a corresponding one of the recess 54 in the mounting ring 24. Further, since the clips 28 are provided with the protrusions 68 and 70, installing the clip basically includes snap-fitting the clip 28 to an outer radial portion of the mounting ring 24. Also, installing the cover 14 includes snap-fitting the cover 14 onto the projections 74 of the clips 28.

Second Embodiment

Figure 18:
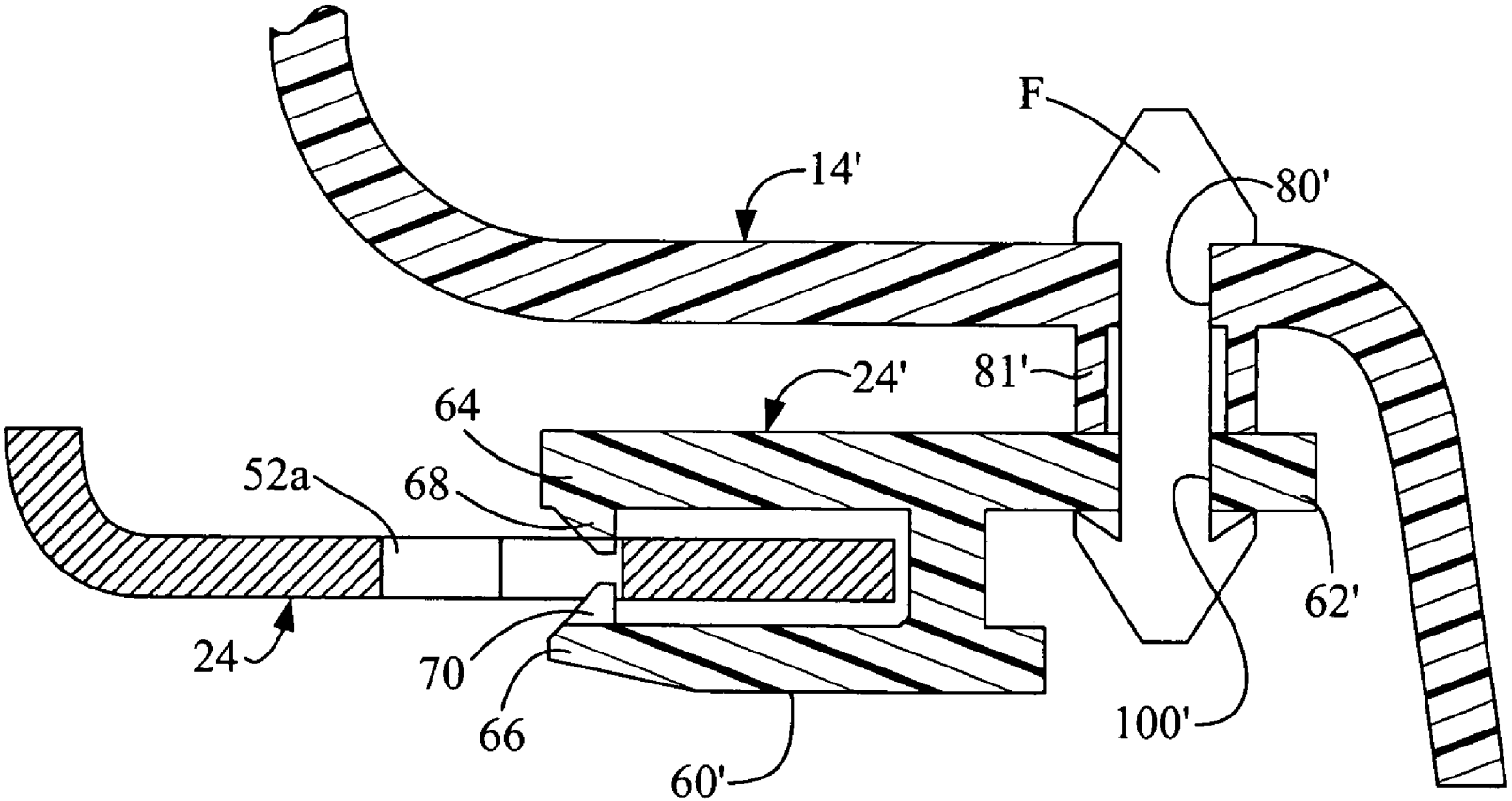
FIG. 18 is a cross-sectional view similar to FIG. 9 showing the mounting ring, the cover and a clip in accordance with a second embodiment of the present invention.
Figure 19:
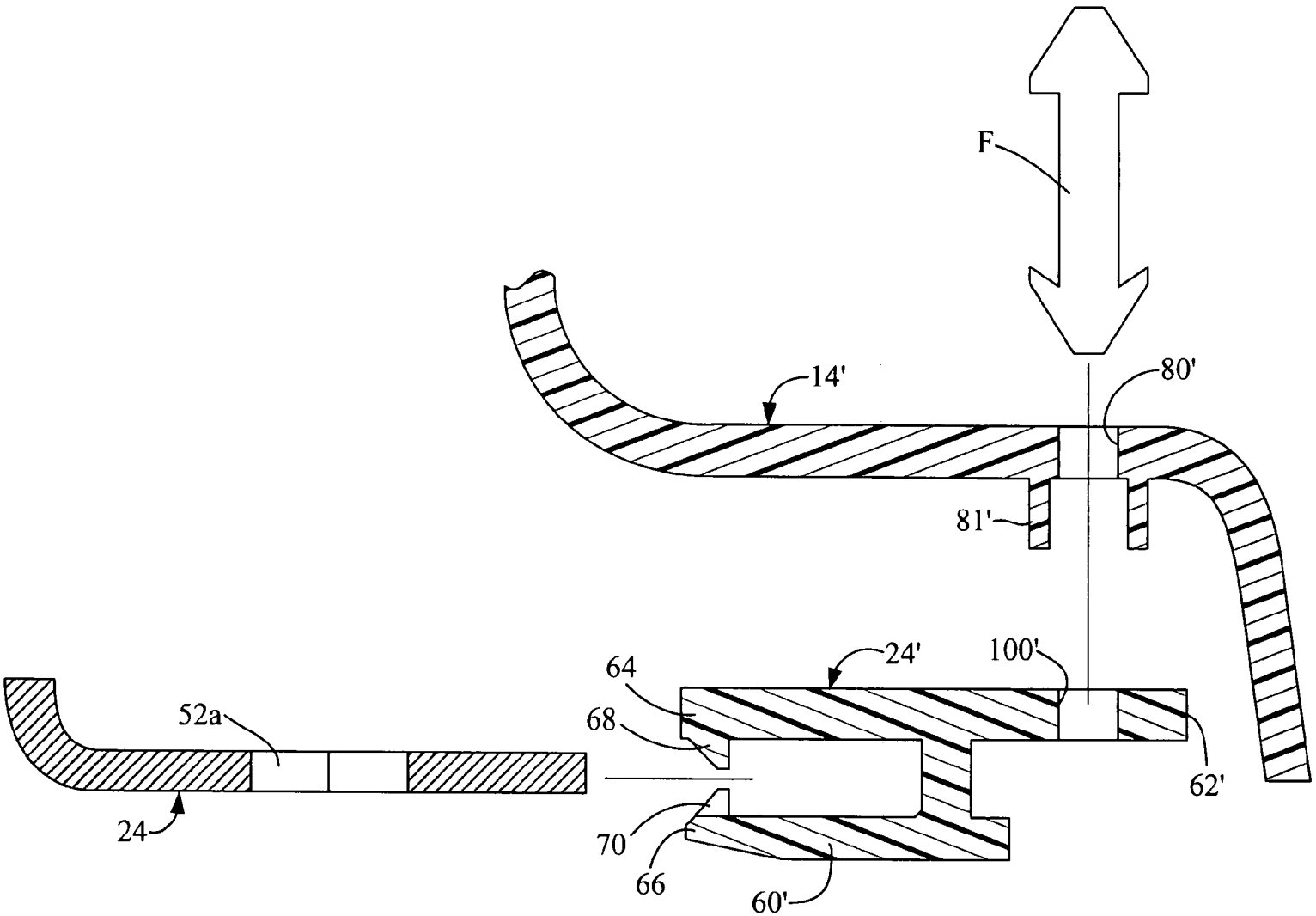
FIG. 19 is an exploded cross-sectional view similar to FIG. 18 showing the mounting ring, the cover and the clip in accordance with the second embodiment of the present invention.
Figure 20:
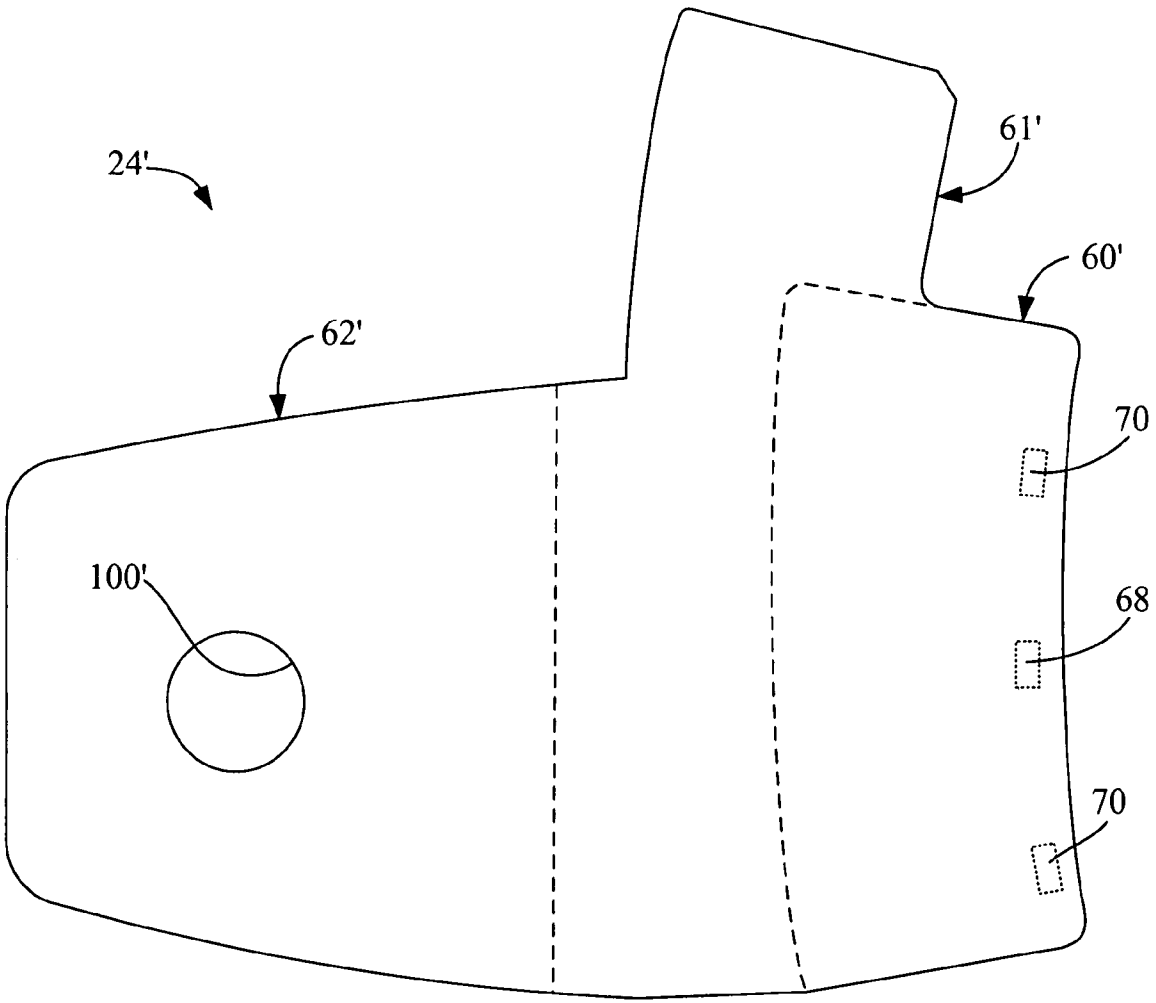
FIG. 20 is an enlarged top view of the clip shown removed from the mounting ring

Referring now to FIGS. 18, 19 and 20, a cover 14' and a clip 24' in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (').

In the second embodiment, the fuel tank 12, the flange 18 and the mounting ring 24 are identical to the first embodiment. In FIGS. 18, 19 and 20, only the mounting ring 24 is depicted, while the fuel tank 12 and the flange 18 are omitted for the sake of clarity.

In the second embodiment, the cover 14' replaces the cover 14 and the clip 24' replaces the clip 24. The cover 14' is similar to the cover 14, but includes spacer blocks 81' around apertures 80'. The clip 24' is similar to the clip 24 in that the clip 24' includes the upper and lower sections 64 and 66 of a ring attachment portion 60' and includes the anti-rotation portion 61. The upper and lower section 64 and 66 further includes the protrusions 68 and 70, as in the first embodiment. However, the clip 24' includes a cover attachment portion 61' that has a projection 74' that extends in a direction away from the upper and lower sections 64 and 66 and is approximately co-planar with the upper section 64 of the ring attachment portion 60'. The cover attachment portion 62' includes an aperture 100'.

In the second embodiment, a plurality of the clips 24' are installed on the mounting ring 24. The cover 14' is positioned over the mounting ring 14 and the clip 24' and a fastener F is inserted into the aperture 80' and further into the aperture 100'. For each pair of the apertures 100' and the clips 24', a fastener F is installed to retain the cover 14' in position relative to the mounting ring 24. The fastener F is preferably a snap-fit fastener with a flexible pair of protrusions that flair outward after insertion into the apertures 100' and 80'.

The vehicle 10 includes a pickup truck cargo bed and other body and suspension components that are conventional components well known in the art. Since these components and structures are well known in the art, these components and structures will not be discussed or illustrated in detail herein. Rather, it will be apparent to those skilled in the art from this disclosure that the components can be any type of structure and/or programming that can be used to carry out the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment (s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vehicle fuel tank assembly, comprising:

a fuel tank having a fuel pump receiving opening and at least one retaining member;

a fuel pump housing disposed in the fuel pump receiving opening such that a portion of the fuel pump housing is exposed;

a removable mounting ring securing the fuel pump housing to the fuel tank, the mounting ring being rotatable between an installation orientation and a retained orientation, the mounting ring having at least one slot dimensioned such that the retaining member of the fuel tank extends through the slot of the mounting ring, the retaining member of the fuel tank and the mounting ring being configured and arranged to operably engage one another to retain the mounting ring in the retained orientation;

at least one attachment member having a cover attachment portion and a ring attachment portion that is retained in the slot of the mounting ring; and a fuel pump cover connected to the cover attachment portion of the attachment member to substantially cover at least the exposed portion of the fuel pump housing.

2. The vehicle fuel tank assembly as set forth in claim 1, wherein the fuel pump housing includes an electrical connector, and the fuel pump cover covers the electrical connector.

3. The vehicle fuel tank assembly as set forth in claim 1, wherein the ring attachment portion of the attachment member includes an anti-rotation portion configured and arranged relative to the mounting ring to prevent movement of the attachment member relative to the mounting ring.

4. The vehicle fuel tank assembly as set forth in claim 1, wherein the attachment member is a one-piece, unitary member.

5. The vehicle filet tank assembly as set forth in claim 1, wherein the mounting ring includes an outer annular surface that has at least one recess, and the ring attachment portion of the attachment member includes an anti-rotation portion that extends into the recess of the mounting ring.

6. The vehicle fuel tank assembly as set forth in claim 5, wherein the ring attachment portion includes a pair of generally parallel engagement elements disposed on opposite sides of the mounting ring.

7. A vehicle fuel tank assembly comprising:

a fuel tank having a fuel pump receiving opening;

a fuel pump housing disposed in the fuel pump receiving opening such that a portion of the fuel pump housing is exposed;

an mounting ring securing the fuel pump housing to the fuel tank, the mounting ring including an outer annular surface that has at least one recess;

at least one attachment member having a ring attachment portion connected to the mounting ring and a cover attachment portion, the ring attachment portion of the attachment member having an anti-rotation portion that extends into the recess of the mounting ring and a pair of generally parallel engagement elements disposed on opposite sides of the mounting ring, the engagement elements extend from the anti-rotation portion; and a fuel pump cover connected to the cover attachment portion of the attachment member to substantially cover at least the exposed portion of the fuel pump housing.

8. The vehicle fuel tank assembly as set forth in claim 7, wherein the attachment member is a one-piece, unitary member.

9. The vehicle fuel tank assembly as set forth in claim 1, wherein the ring attachment portion at least partially surrounds a portion of the mounting ring and retains the attachment member on the mounting ring.

10. The vehicle fuel tank assembly as set forth in claim 1, wherein the ring attachment portion includes a pair of generally parallel engagement elements disposed on opposite sides of the mounting ring.

11. The vehicle fuel tank assembly as set forth in claim 10, wherein the engagement elements of the ring attachment portion include opposing projections configured to couple the attachment member to the mounting ring via a snap-fit.

12. The vehicle fuel tank assembly as set forth in claim 10, wherein the cover attachment portion of the attachment member includes a projection extending generally perpendicular from one of the engagement elements to engage the fuel pump cover via a snap-fit.

13. The vehicle fuel tank assembly as set forth in claim 12, wherein the projection of the cover attachment portion has a conical shaped free-end and an undercut lower portion defining a cover receiving recess.

14. The vehicle fuel tank assembly as set forth in claim 12, further comprising a plurality of the attachment members, and the fuel pump cover includes a corresponding plurality of spaced apart apertures dimensioned to receive the vertical projections of the plurality of the attachment members.

15. The vehicle fuel tank assembly as set forth in claim 1, wherein the cover attachment portion of the attachment member includes a projection extending generally perpendicular from one of the engagement elements to engage the fuel pump cover via a snap-fit.

16. The vehicle fuel tank assembly as set forth in claim 15, wherein the projection of the cover attachment portion has a conical shaped free-end and an undercut lower portion defining a cover receiving recess.

17. The vehicle fuel tank assembly as set forth in claim 1, wherein the cover attachment portion of the attachment member includes a fastener aperture.

18. The vehicle fuel tank assembly as set forth in claim 17, wherein the fuel pump cover includes an aperture aligned with the fastener aperture.

19. The vehicle fuel tank assembly as set forth in claim 1, further comprising a snap-fit fastener extending through an aperture in the fuel pump cover and a fastener aperture in the cover attachment portion of the attachment member.

20. The vehicle fuel tank assembly as set forth in claim 1, wherein the fuel pump cover completely covers at least the mounting ring and the fuel pump housing.

21. A method of assembling a vehicle fuel tank comprising:

installing a fuel pump housing in a fuel tank opening of a fuel tank having retaining members;

positioning a removable mounting ring on the fuel tank and the fuel pump housing such that the retaining members extend through corresponding slots in the mounting ring;

rotating the mounting ring to secure the fuel pump housing to the fuel tank such that the retaining members and the slot cooperate to retain the fuel pump housing to the fuel tank and in a retained orientation;

installing at least one attachment member to the mounting ring such that a section of the attachment member extends into the slot of the mounting ring; and installing a cover on the at least one attachment member with the fuel pump cover covering the fuel pump housing and the mounting ring.

22. The method as set forth in claim 21, wherein the installing of the attachment member comprises moving the attachment member along a plane coinciding with an outer radial portion the mounting ring; and the installing of the cover comprises moving the cover in a direction perpendicular to the plane.

23. The method as set forth in claim 21, wherein the installing of the attachment member includes inserting an anti-rotation portion of the attachment member into a corresponding recess in the mounting ring.

24. The method as set forth in claim 21, wherein the installing of the attachment member comprises snap-fitting the attachment member onto an outer radial portion of the mounting ring.

25. The method as set forth in claim 21, wherein the installing of the cover comprises snap-fitting the cover onto projections of the attachment member.

26. The method as set forth in claim 21 wherein the installing of the cover comprises installing a snap-fitting fastener into an aperture formed in the cover and further through an aperture formed in the attachment member.

27. The vehicle fuel tank assembly as set forth in claim 10, wherein one of the engagement elements of the ring attachment portion extends at least partially between an outer surface of the fuel tank and a first surface of the mounting ring and the other of the engagement elements of the ring attachment portion extends at least partially along a second surface of the mounting ring.

28. The vehicle fuel tank assembly as set forth in claim 27, wherein the engagement elements of the ring attachment portion include opposing projections that extend into the slot of the mounting ring.

29. The vehicle fuel tank assembly as set forth in claim 10, wherein the engagement elements of the ring attachment portion include opposing projections that extend into the slot of the mounting ring.

30. The vehicle fuel tank assembly as set forth in claim 7, further comprising:

a plurality of the at least one attachment member installed to the mounting ring with the fuel pump cover attached to the plurality of the at least one attachment member.

31. A vehicle fuel tank assembly, comprising:

a fuel tank having a fuel pump receiving opening;

a fuel pump housing disposed in the fuel pump receiving opening such that a portion of the fuel pump housing is exposed;

an annular shaped mounting ring securing the fuel pump housing to the fuel tank, the mounting ring being rotatable between an installation orientation and a retained orientation, the mounting ring having at least one slot;

at least one attachment member having a cover attachment portion and a ring engagement portion with at least one ring engagement element, the at least one ring engagement element having a projection that extends into the slot; and a fuel pump cover connected to the cover attachment portion of the attachment member to substantially cover at least the exposed portion of the fuel pump housing.

32. The vehicle fuel tank assembly as set forth in claim 31, wherein the attachment member is a one-piece, unitary member.

33. The vehicle fuel tank assembly as set forth in claim 31, wherein a plurality of the at least one attachment member is installed to the mounting ring with the fuel pump cover attached to the plurality of the at least one attachment member.

34. The vehicle fuel tank assembly as set forth in claim 31, wherein the mounting ring includes an outer annular edge that has at least one recess, and the attachment member includes an anti-rotation portion that extends into the recess of the mounting ring.

35. The vehicle fuel tank assembly as set forth in claim 31, wherein the slot extends between a first surface and a second surface of the mounting ring.

36. The vehicle fuel tank assembly as set forth in claim 35, wherein the ring engagement portion comprises a first and second ring engagement elements;

the first ring engagement element having a projection that extends into the slot from adjacent to the first surface of the mounting ring and the second ring engagement element having a projection that extends into the slot from adjacent the second surface of the mounting ring.

37. The vehicle fuel tank assembly as set forth in claim 31, wherein the engagement portion of the attachment member is configured and arranged to interfere with rotation of the mounting ring from the retained orientation to the installation orientation position when the at least one ring engagement elements extend into the slot.

* * * * *